United States Patent [19]

French

[11] Patent Number: 4,802,297

[45] Date of Patent: Feb. 7, 1989

[54] BULLET LUBRICATING APPARATUS

[75] Inventor: Kendrick L. French, Lebanon, Me.

[73] Assignee: K. W. Thompson Tool Company, Inc., Rochester, N.H.

[21] Appl. No.: 109,497

[22] Filed: Oct. 16, 1987

[51] Int. Cl.[4] ..... F41C 27/00

[52] U.S. Cl. ..... 42/90; 86/19

[58] Field of Search ..... 42/90; 86/19

[56] References Cited

U.S. PATENT DOCUMENTS

| | | | |
|---|---|---|---|
| 2,133,873 | 10/1938 | Sharp | 86/19 |
| 2,403,032 | 7/1946 | Stevens | 86/19 |
| 4,112,606 | 9/1978 | Griffin | 42/90 |
| 4,254,572 | 3/1981 | Nelson | 42/90 |
| 4,353,282 | 10/1982 | Holt | 42/90 |
| 4,393,613 | 7/1983 | Knosky | 42/90 |
| 4,434,571 | 3/1984 | Eisenhuth | 42/9 |
| 4,533,019 | 8/1985 | Leding | 42/90 |

*Primary Examiner*—Charles T. Jordan

*Attorney, Agent, or Firm*—Blodgett & Blodgett

[57] ABSTRACT

Apparatus for attachment to a container of lubricant, including a tubular main body through which bullets are passed to receive lubricant.

2 Claims, 1 Drawing Sheet

BULLET LUBRICATING APPARATUS

BACKGROUND OF THE INVENTION

In the operation of firearms, it is sometimes desirable to apply lubricant to the bullets before they are inserted in the gun. This is particularly true in the case of muzzle loading rifles with which the projectile is separate from the powder and wadding, especially in those cases where the projectile is provided with circumferential grooves. The lubricant serves several purposes, i.e., facilitating the introduction of the bullet into the barrel of the gun and of sealing against the escape of gases around the bullet when the gun is fired.

Originally, the lubricant was applied with the fingers. This was not entirely satisfactory, not only because it was messy, but also because there was non-uniformity of application of the lubricant to the bullet. Apparatus was developed to assist in applying the lubricant to the bullet, but this prior art apparatus was not only complicated and expensive, but also involved a time-consuming operation. These and other difficulties experienced with the prior art devices have been obviated, in a novel manner, by the present invention.

It is, therefore, an outstanding object of the invention to provide an apparatus for applying lubricant to a bullet without necessitating contact of the hands with the lubricant.

Another object of the present invention is the provision of a lubricating apparatus in which the lubricant can be applied very rapidly and sequentially to a series of bullets.

A further object of the present invention is the provision of an apparatus for applying lubricant thoroughly to a bullet whose surface is configured, as by circumferential grooves.

It is another object of the instant invention to provide a lubricating apparatus that is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the present invention relates to an apparatus for use in lubricating bullets, the apparatus consisting of a main body having a bore with a diameter slightly larger than he diameter of one of the bullets, the bore extending completely through the main body and having an entrance into which the bullets may be introduced seriatim. An exit is provided from which a bullet may be ejected and a branch portion is provided extending at a right angle to the centerline of the bore. The said branch portion being adapted to fit over a discharge opening of a container of lubricant, the branch portion having a passage adapted to lead from the discharge opening of the said container to the midpoint of the bore of the main body.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
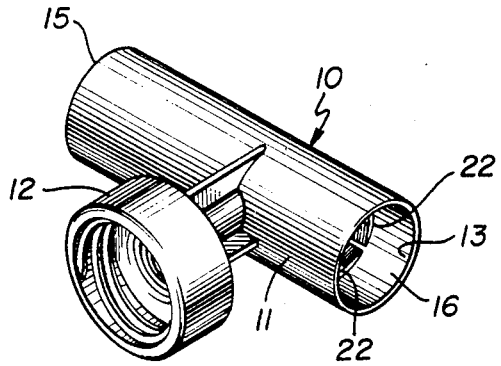
FIG. 1 is a perspective view of a lubricating apparatus embodying the principles of the present invention.
Figure 2:
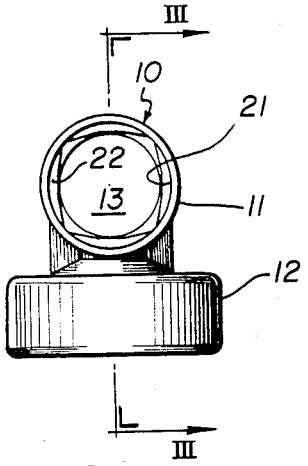
FIG. 2 is a front elevational view of the apparatus.

Referring first to FIG. 1, which best shows the general features of the invention, the lubricating apparatus, indicated generally by the reference numeral 10, is shown as having a generally tubular main body 11 and a branch portion 12.

Figure 4:
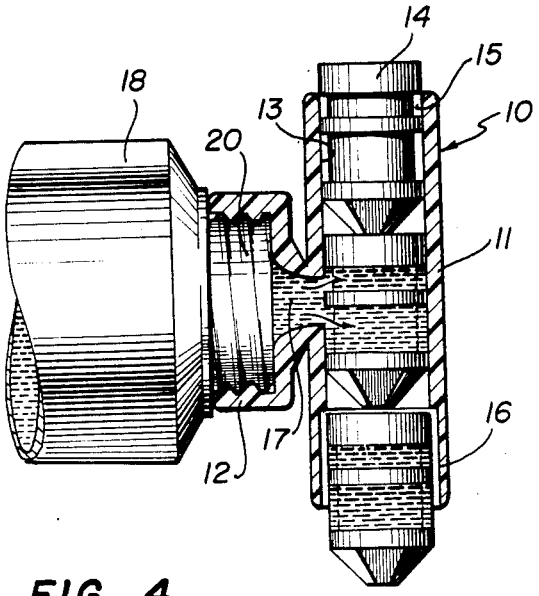
FIG. 4 is a sectional view of the apparatus showing it in use with bullets and a container of lubricant.

The main body 11 has a bore 13 whose diameter is slightly larger than that of a bullet 14 (see FIG. 4). The bore extends completely thorough the main body and has an entrance 15 into which the bullets may be introduced seriatim. The other end of the bore 13 constitutes an exit 16 from which the bullets may be ejected.

The branch portion 12 extends laterally from the mid-portion of the main body 11; it is generally tubular and its axis lies at a right angle to the axis of the bore 13 in the main body. The branch portion is configured to fit over a discharge neck 20 (FIG. 4) of a container 18 of lubricant. The branch portion has a passage 17 leading to the midpoint of the bore 13.

Figure 3:
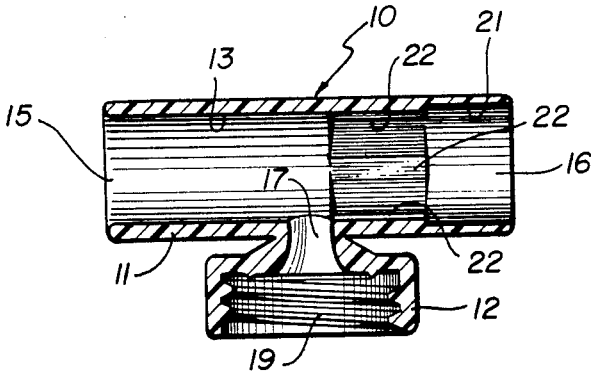
FIG. 3 is a sectional view of the apparatus taken on the line III—III of FIG. 2.

In FIGS. 3 and 4 it can be seen that the branch portion is provided with internal threads 19 to cooperate with external threads on the lubricant container. The bore is provided with a counterbore 21 adjacent the exit 16, the counterbore serving to facilitate the movement of a bullet out of the exit. Pads 22 occupy part of the counterbore to guide the bullet.

The operation and advantages of the invention will now be readily understood in view of the above description. Referring to FIG. 4, it can be seen that the branch portion 12 of the apparatus is tightly threaded onto the discharge neck 20 of the container 18 which holds a supply of a suitable lubricant. The bullets 14 are inserted one-at-a-time into the entrance 15 of the bore 13. In order to do this, the main body is held in a vertical position with the entrance 15 uppermost and the exit 16 extending downwardly.

As each bullet 15 is introduced into the bore, any preceeding bullet is advanced ahead of it a bullet length along the bore. In the preferred embodiment the main body 11 and its bore 13 have a length equal to the combined lengths of three bullets. This means that, at any given time, three bullets lie in the bore; one bullet lies in the central portion adjacent the passage 17, while the other two lie in the entrance 15 and the exit 16, respectively.

While the central bullet lies adjacent the passage 17, a quantity of lubricant is forced out of the container 18 from the discharge neck 20 through the passage 17 into the bore and around the bullet. A suitable quantity of lubricant is introduced around the bullet to fill its grooves, if such are provided. When a new bullet is introduced at the entrance 15, the previously-introduced bullet is moved to the central (lubricating)position and a previously lubricated bullet moves into the counterbore 21, and the exit 16 and falls out into a bullet container (not shown). The guide pads 22 serve to guide the bullet through the counterbore 21, while retaining it until the following bullet has been lubricated.

It can be seen, then, that the simplicity of construction of the invention leads to inexpensive manufacture, as well as resistance to being rendered inoperative by exposure to a rugged environment. It is possible, by careful manipulation, to lubricate a series of bullets very rapidly without the operator receiving lubricant on his hands and other equipment. Furthermore, the amount of lubricant applied to the bullets is consistent through the series It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Apparatus for use in lubricating bullets, comprising:

(a) a main body having a bore with a diameter slightly larger than the diameter of one of the bullets, the bore extending completely through the main body and having an entrance into which the bullets may be introduced seriatim as well as an exit from which a bullet may be ejected, and (b) a branch portion extending at a right angle to the centerline of the bore, the said portion being adapted to fit over a discharge opening of a container of lubricant, the branch portion having a passage adapted to lead from the discharge opening of the said container to the midpoint of the bore of the main body, the main body and the branch portion being integrally formed of clear plastic, so that flow of lubricant around a bullet can be observed, the length of the bore being equal to the length of three bullets, so that one bullet can reside adjacent the entrance to the bore, another bullet can reside in the midportion of the bore adjacent the said passage, and another bullet can reside adjacent the exit of the bore, wherein the bore adjacent the exit is provided with a counterbore to facilitate the movement of the bullet out of the bore, and wherein a plurality of pads occupy a portion of the counterbore adjacent the midportion of the bore to guide the bullet through the counterbore.

2. Apparatus as recited in claim 1 wherein each pad has a flat contact surface that is tangential to an imaginary extension of the bore.

* * * * *